United States Patent [19]

Hemphill

[11] 4,123,861

[45] Nov. 7, 1978

[54] METHOD OF EXCAVATING EARTH WITH A BUCKET

[76] Inventor: Charles W. Hemphill, 1106 Green Valley La., Duncanville, Tex. 75116

[21] Appl. No.: 792,338

[22] Filed: Apr. 29, 1977

Related U.S. Application Data

[62] Division of Ser. No. 715,560, Aug. 18, 1976, Pat. No. 4,037,337.

[51] Int. Cl.[2] ..... E02F 1/00

[52] U.S. Cl. ..... 37/195

[58] Field of Search ..... 37/195, 141 R, 141 T, 37/142 R, 142 A, 142.5, 118, 117.5, 103, 115–117

[56] References Cited

U.S. PATENT DOCUMENTS

| | | | |
|---|---|---|---|
| 1,357,359 | 11/1920 | Specht | 37/103 |
| 1,659,768 | 2/1928 | Dietrich | 37/118 R X |
| 3,307,277 | 3/1967 | Kondracki | 37/141 R |
| 3,531,161 | 9/1970 | Conn | 37/103 X |
| 3,791,054 | 2/1974 | Bierwith | 37/141 R |
| 3,914,885 | 10/1975 | Moreau | 37/141 R |

FOREIGN PATENT DOCUMENTS

| | | | |
|---|---|---|---|
| 2,251,896 | 5/1973 | Fed. Rep. of Germany | 37/195 |
| 2,255,427 | 12/1973 | France | 37/103 |
| 145,234 | 5/1954 | Sweden | 37/103 |
| 306,228 | 6/1971 | U.S.S.R. | 37/141 R |
| 388,101 | 10/1973 | U.S.S.R. | 37/118 R |

*Primary Examiner*—E. H. Eickholt
*Attorney, Agent, or Firm*—Marcus L. Bates

[57] ABSTRACT

An improved excavating bucket having special excavating teeth thereon for use with a backhoe type digging machine. The teeth are affixed in spaced relation to a leading edge of the bucket, with there being a central and a lowermost tooth; opposed, intermediate digging teeth; and, opposed outermost digging teeth.

The intermediate teeth are located rearwardly and below the outermost teeth, and forwardly and above the central tooth. The interior of the bucket is of a special configuration which enhances the dumping of excavated material therefrom.

26 Claims, 29 Drawing Figures

METHOD OF EXCAVATING EARTH WITH A BUCKET

BACKGROUND OF THE INVENTION

This application is a division of application Ser. No. 715,560, filed Aug. 18, 1976 and now U.S. Pat. No. 4,037,337.

The modern backhoe, sometimes called a "pull shovel", is of a design which results from combining the most desirable features taken from the prior art steam shovel and drag line.

The prior art steam shovel bucket is rigidly affixed to a movable boom and is arranged to cut or excavate while going upwardly and away from the machine. This arrangement causes the bucket to work at a mechanical disadvantage and the weight of the machine must therefore be greater than the resulting forces encountered while making the cut. Moreover, the machine must be positioned in its own excavation so that it works at the bottom of the cut.

The drag line, on the other hand, digs in opposition to the shovel, with its bucket suspended from a boom by a series of cables so that the bucket is swung away and pulled towards the machine. The drag line works above its cut thereby enabling it to excavate a relatively narrow trench of varying depth as well as enabling it to work in water or mud. The drag line provides the mechanical advantage of working below and pulling the bucket toward the machine. The operation is not directly dependent upon the weight of the machine in order to effect the pull of the cut. The major disadvantage found in the drag line is the inability to precisely position and control the bucket because of its cable suspension arrangement. Furthermore, the downward digging force applied to the bucket is dependent upon the weight thereof as well as the skill of the operator.

The modern backhoe is a combination of recent advances in hydraulics along with the most desirable features found in the steam shovel and the drag line. The backhoe bucket is affixed to a movable boom and is turned in a direction to make the cut towards the backhoe machine. The bucket boom is arranged to enable the machine to be positioned on top of the cut, thereby providing the mechanical advantage of disposing the bucket so that it cuts from below and towards the machine.

Before the advent of modern hydraulics, the backhoe depended upon weight and brute force for proper performance of its digging function. Modern hydraulic systems have substantially reduced the weight of the machine, thereby eliminating the need for a heavy bucket and boom. Modern hydraulics also enables the bucket to be movably affixed to the boom, thereby enabling the cutting edge of the bucket to be continually adjusted for optimum alignment regardless of the position of the boom.

With the exception of being made lighter, backhoe buckets have remained essentially unchanged from the original design created from the combination of features taken from the steam shovel and the drag line bucket. In order for the backhoe bucket to penetrate the material to be excavated, it is essential that the digging teeth thereof be placed in aligned relationship on the lower flat surface of the leading edge of the bucket. The magnitude of force required to effect penetration of the bucket into the earth is related to the number and location of teeth. The fewer the teeth, the more difficult is the pulling of the bucket. Therefore, a compromise has heretofore been necessary in selecting the number of teeth to be employed on the prior art bucket.

The area of the bucket lip which is not covered by excavating teeth must be forced into the ground with a tearing effect. This represents a tremendous expenditure of power. Formations such as soapstone, will not easily tear or shatter as it is penetrated by the teeth, but instead, the individual teeth form a series of spaced grooves. As the lip of the bucket contacts the ridges between the spaced grooves, the digging can no longer proceed. The tremendous forces required by the tearing effect therefore limits the amount of work a specific backhoe can achieve.

Conventional backhoe buckets are tapered with the bucket being wider at the leading edge as compared to the trailing edge thereof. The teeth usually are arranged to simultaneously cut on the same plane; and accordingly, when the bucket encounters damp or muddy conditions, a substantially solid cube of material is torn loose and forced back into the tapered bucket. Hence, this design is satisfactory for excavating dry material, but is undesirable for digging into wet material because the cube of removed material is tightly packed within the tapered interior of the bucket. Hence, movement of the bucket into the uncurled configuration fails to empty the bucket because the excavated material sticks to the sidewalls thereof and refuses to be discharged therefrom.

Digging in wet or plastic-like material represents one of the major problems associated with the backhoe. Digging in hard formations, such as the above example of soapstone, presents a similar problem to the backhoe. It would therefore be desirable to have made available a backhoe bucket of a design which represents a definite step forward in overcoming the above-recited problems. The solution to this problem is the subject of the present invention.

SUMMARY OF THE INVENTION

This invention relates to excavating equipment, and specifically to an excavating bucket having a leading edge spaced from a trailing end and means forming a plurality of cutting members located thereon which define at least part of said leading edge. The cutting members are arranged in a specific pattern and include a central digging member; opposed, intermediate digging members; and, opposed, outermost members. Each digging member is spaced from one another with the intermediate members being located rearwardly and below said outermost members, and further being located forwardly and above the central member.

The interior of the bucket is contoured in a special manner with the bottom thereof having opposed adjacent sides which slope in a downwardly direction toward one another, with the slope progressively increasing in a direction toward the central tooth. The back wall of the bucket is curved from a vertical plane which connects to the curved bottom thereof. This configuration of the bucket provides unexpected improvements in structural integrity as well as improvements in the digging and dumping characteristics thereof.

The excavating teeth each include a penetrating member and a lifting member, with the penetrating member proceeding the lifting member. The teeth which are located on either side of the centrally located tooth are each contoured in a special manner to cause excavated material to be turned towards the center of the bucket as the individual teeth excavate material from the ground. The teeth, together with the bucket design, enhance both the digging and dumping attributes thereof.

Various different embodiments of the bucket and the excavating teeth are set forth herein and may be individually employed to attain great advantage over the prior art.

A primary object of this invention is to provide improvements in excavating buckets which result in increased digging efficiency.

Another object of the invention is to provide a new method of excavating material.

A further object of this invention is to disclose and provide improvements in excavating teeth associated with apparatus for digging into the earth.

A still further object of this invention is to provide a new combination comprised of digging teeth and an excavating bucket.

Another and still further object is to provide improved digging and dumping characteristics for the bucket of a backhoe.

An additional object of this invention is to provide an improved arrangement of excavating teeth on an excavating bucket.

Another object of the invention is to provide an improved bucket design which reduces the tendency of mud to become packed therein.

A further object of this invention is to provide improvements in excavating buckets and teeth which overcome many prior art disadvantages.

These and other objects and advantages of the invention will become readily apparent to those skilled in the art upon reading the following detailed description and claims and by referring to the accompanying drawings.

The above objects are attained in accordance with the present invention by the provision of improved apparatus and method for excavating material from the earth, substantially as described in the above abstract and summary.

DETAILED DESCRIPTION OF THE PREFERRED EMBODIMENTS

Figure 1:
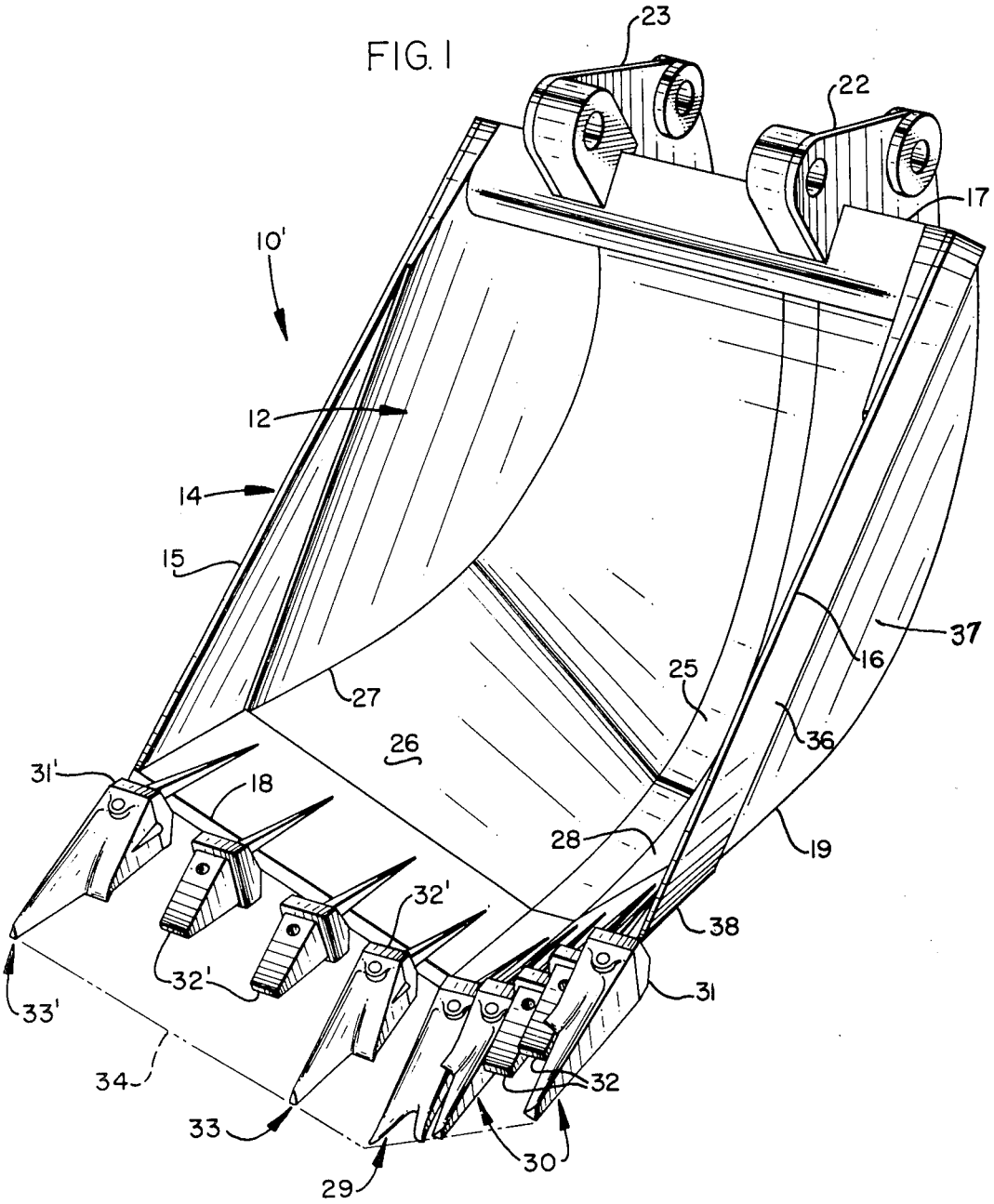
FIG. 1 is a three-quarter, front perspective view of an excavating bucket made in accordance with the present invention.
Figure 2:
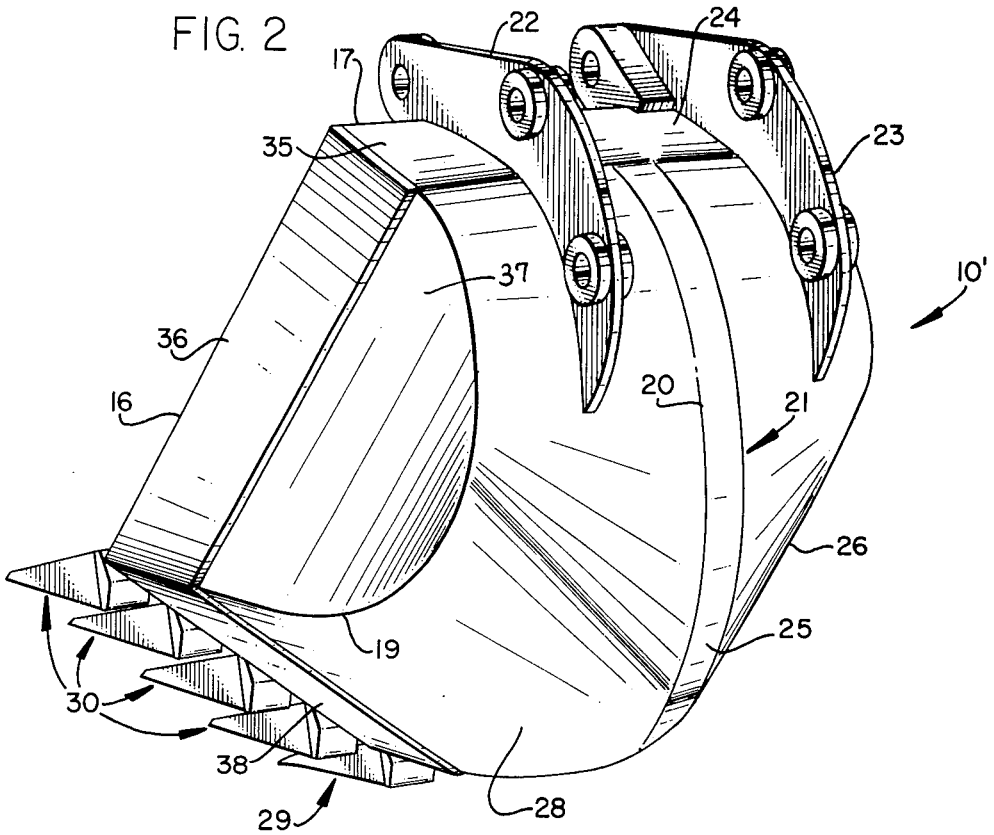
FIG. 2 is a three-quarter, rear perspective view of the bucket disclosed in FIG. 1.

FIGS. 1 and 2 of the drawings disclose a bucket 10' made in accordance with the present invention. The interior 12 of the bucket opens in an outward direction, with the opening being in the form of a polygon which is defined by a peripheral edge 14. The perimeter of the opening includes an edge portion 15 located on one side of the bucket, an edge portion 16 presented by the opposed side of the bucket, an end 17 formed by the illustrated rear member of the bucket, and a leading edge portion 18 presented by the V-shaped bottom of the bucket.

The bottom and side walls are joined together in the illustrated manner indicated by numeral 19, while the rear and bottom of the bucket are joined together in the manner indicated by numeral 20. The rear and bottom walls progressively curve toward one another where one becomes the other as they meet at some arbitrary location broadly indicated by the arrow at numeral 21.

Suspension members 22 and 23 are rigidly attached to the rear of the bucket to provide mount means by which the bucket can be attached to the dipper stick of a backhoe in the usual manner. The interior of the bucket adjacent to the leading edge is wider, or of greater cross-section, as compared to the interior of the bucket adjacent to the trailing end. A centrally located keel 25 extends from and forms a central part of both the rear and bottom wall. The bottom wall is comprised of two opposed sloped portions 26 and 28, each of which are attached to the side walls where they downwardly slope towards one another into attachment to the keel.

A central excavating tooth 29, which can take on any number of different forms, is fowardly attached to the keel 25. Numeral 30 indicates a plurality of specifically made teeth which are positioned forwardly of bottom 28 and laterally of the central tooth. Numerals 31 and 31' indicate the rear portion of opposed tooth-receiving sockets by which the teeth of the present invention are removably mounted to the lip or forward edge portion 18 of the bucket.

As best seen illustrated in FIGS. 1 and 2, numeral 32 indicates a plurality of intermediate tooth receiving sockets which are located on one side of the bucket lip, while numeral 32' indicates a plurality of opposed intermediate sockets which are located on the opposed side or bottom of the bucket. Numeral 33 indicates a plurality of teeth which are mirror images of the teeth 30 located on the opposed side of the bucket. Numeral 34 is two connected straight lines indicating the terminal leading edge of the excavating teeth.

Accordingly, the excavating teeth of the present invention are arranged on the leading edge of the excavator bucket such that there is a central excavating tooth 29, a plurality of excavating teeth 30 located laterally of the central tooth, and a plurality of opposed excavating teeth 33 located laterally of the bucket, with there being intermediate teeth attached to sockets 32 and 32', and with there being opposed outermost teeth affixed to the sockets at 31 and 31'.

Figure 3:
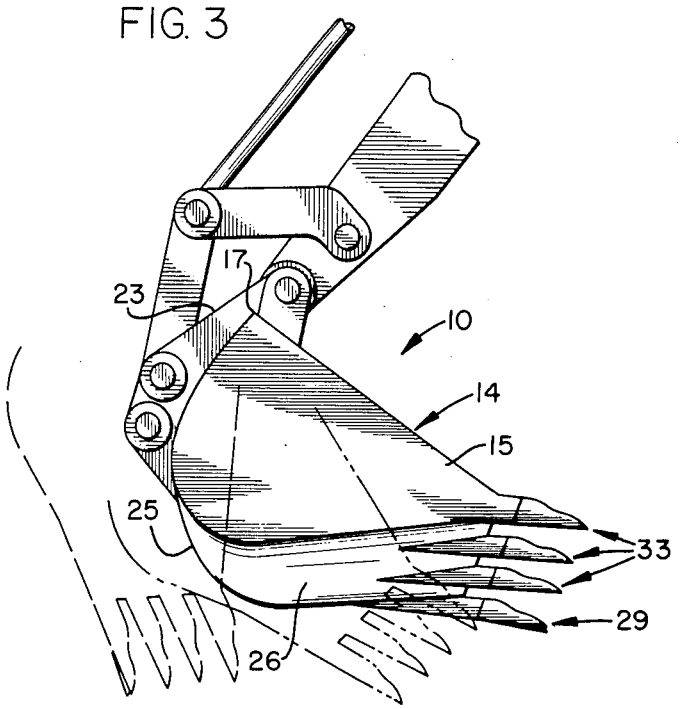
FIG. 3 is a fragmented, side elevational view of another bucket, similar to the bucket disclosed in FIGS. 1 and 2.

As seen illustrated in FIGS. 4–9, in conjunction with FIGS. 1–3, the central tooth 29 is the lowermost and rearwardmost located tooth, with each tooth adjacent thereto being progressively located forwardly and above the central tooth, with the teeth 30 located on one side of the bucket being mirror images of the teeth 33 located on the opposed side of the bucket, and with the central tooth having a configuration which differs from the configuration of the teeth located on opposed sides of the bucket.

Figure 8:
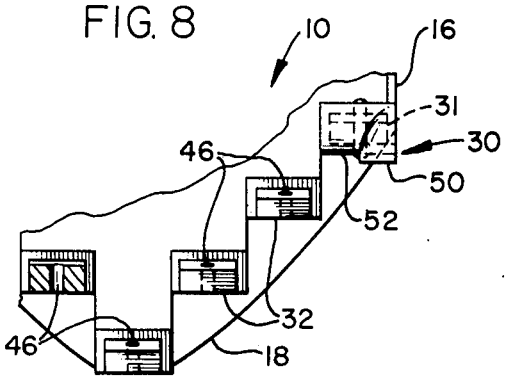
FIG. 8 is a fragmented, front view, similar in some respects to the disclosure as seen in FIG 4.
Figure 9:
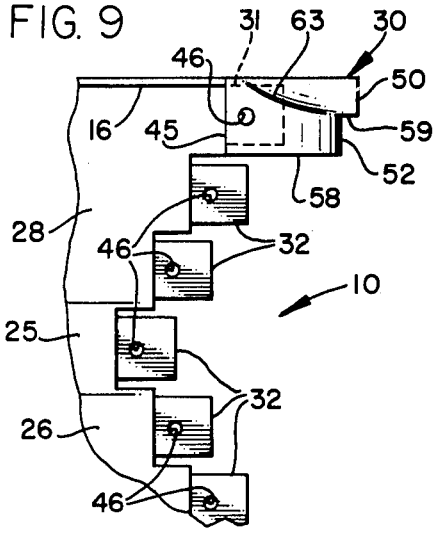
FIG. 9 is a fragmented, top view, similar to the disclosure of FIG. 5.

As best seen illustrated in FIGS. 8 and 9, conjunction with other figures of the drawings, the excavating teeth have a rear end 45 of a hollow configuration made complimentary respective to the sockets 32 so as to enable the teeth to be wedgedly received thereagainst. Aperture 46 vertically extends through both the teeth and socket to enable the teeth to be individually pinned to their respective socket.

In the various figures of the drawings, the massive plate member 35 forms the upper marginal end of the rear wall which is tied to the adjacent opposed similar plate members 36. Members 36 form the outer marginal end of the opposed side walls. The side walls 37 are tied to the opposed plate members and to the sloped bottom walls. Opposed bottom plate members 38 form the leading marginal edge portion of the bottom walls and receive the tooth sockets in mounted relation thereto so that the resulting structural integrity of the bucket can withstand the tremendous force which must be imparted into the digging teeth mounted thereon.

Accordingly, the excavator bucket of the present invention is comprised of a massive entrance made of plate members 35, 36, and 38 which are tied to the side walls, rear wall, and bottom wall, with the rear wall commencing to slope in a downward direction toward the keel 25 after leaving plate member 35, with the magnitude of the slope progressing where the rear and bottom walls join, and where the slope continues to progressively increase towards the member 38.

The teeth-receiving sockets can take on any number of different forms, but preferably are fabricated in the illustrated manner of FIGS. 1–9. The teeth illustrated herein are specifically designed to be received by the sockets and arranged in the novel tooth pattern illustrated in the drawings for optimum efficiency. The lowermost and central tooth is fabricated symmetrically so that the forward edges of the tooth engage the ground with a digging action, and thereafter lifts material in an upward direction. FIGS. 1, 4, 5, 17, and 23 illustrate the preferred form of the central excavating tooth. The teeth 30 are made into a configuration which turns the material toward the central tooth. The teeth 33 are mirror images of the teeth 30 so that the teeth 33 likewise turn the material toward the centrally located digging tooth.

The central tooth is located so that it is the lowermost and rearwardmost of the plurality of teeth. The remaining teeth are located forwardly, laterally, and upwardly respective to the central tooth, with the teeth on one side of the bucket being mirror images of the corresponding teeth located on the opposed side, and with the correspondingly located teeth on opposed sides being positioned at the same elevation and at the same forward displacement. The outermost teeth are positioned at the fowardmost, outermost, and uppermost location respective to the lowermost, rearwardmost, centrally located tooth.

The stair-stepped, spaced, sawl-tooth configuration of the teeth present a cutting edge or cutting surface at the forward end of the digging bucket which engages each increment of excavated material. The teeth cooperate together to roll the individual increments of excavated material upwardly and toward the center of the bucket as the material is forced up into the interior thereof.

The sloped bottom and rear walls of the bucket present a supporting surface to the excavated material in such a manner that the material has very little tendency to stick thereto. Moreover, wet, sticky, excavated material is not packed into the bucket, but instead is received therein as discrete increments of material which retains a self-supporting form and thereby avoids being packed or compressed into a highly dense solid mass or cube of plastic material. This cooperative action between the teeth and the bucket presents a phenomenon which enhances the dumping characteristics of the bucket as it is uncurled into the dumping configuration.

Stated differently, the action of the bucket as it receives the excavated material from the plurality of digging teeth is similar to placing a mass of spaghetti into the bucket, whereas the prior art bucket and teeth is analogous to placing a mass of mashed potatoes thereinto. The mashed potatoes, naturally, stick with great adherence to the sidewalls of the bucket and is therefore quite difficult to dump therefrom, whereas a mass of spaghetti has decidedly less tendency to adhere to the sidewalls of the bucket because of the discrete, individual, extruded form thereof.

Figure 10:
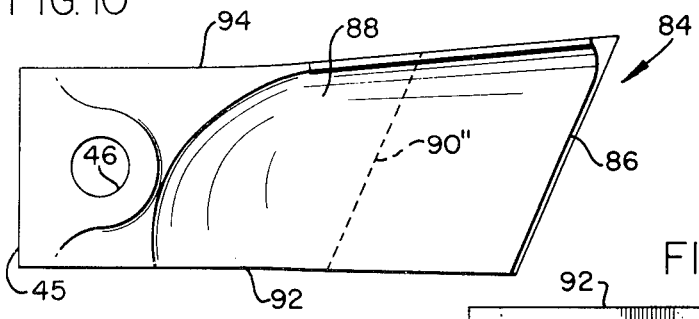
FIG. 10 is a top plan view of one embodiment of the excavating tooth which can be used in conjunction with the bucket of the present invention.
Figure 11:
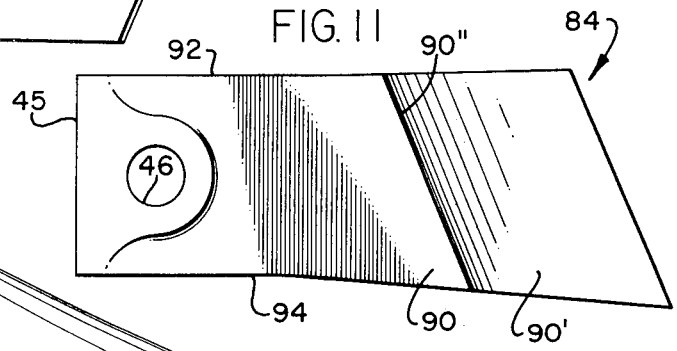
FIG. 11 is a bottom view of the tooth disclosed in FIG. 10.
Figure 12:
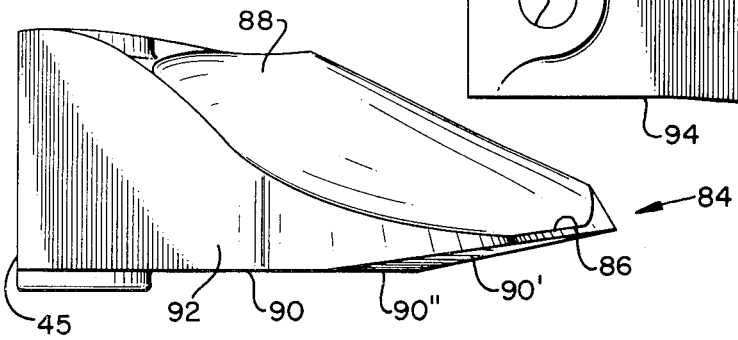
FIG. 12 is a side elevational view of the tooth disclosed in FIGS. 10 and 11.

In FIGS. 10–12 there is disclosed a specific digging tooth 84 having a leading edge 86 spaced from the rear 45 thereof. The paddle-shaped tooth includes an upper face 88 which upwardly slopes from the penetrating inclined forward edge 86 toward the rear, and which upwardly slopes from foreshortened side 92 toward the longer side 94. The bottom of the tooth includes the connected faces 90 and 90'. The face 90' upwardly slopes toward the leading edge 86 and joins the relatively flat face 90 and 90''. Leading edge 86 is inclined, or set at an angle, with respect to the vertical, with the interface formed between faces 90 and 90' being disposed substantially parallel to the leading edge 86.

Figure 13:
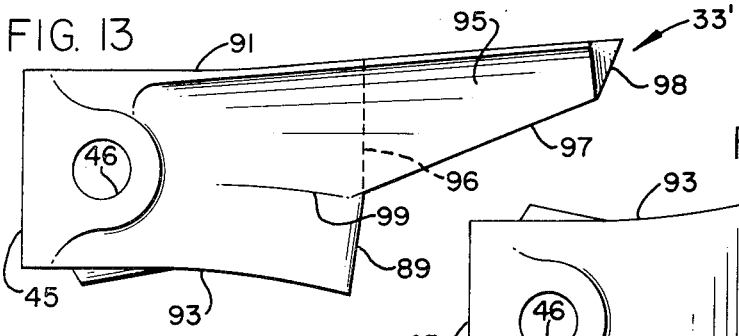
FIG. 13 is a top plan view of another embodiment of an excavating tooth made in accordance with the present invention.
Figure 14:
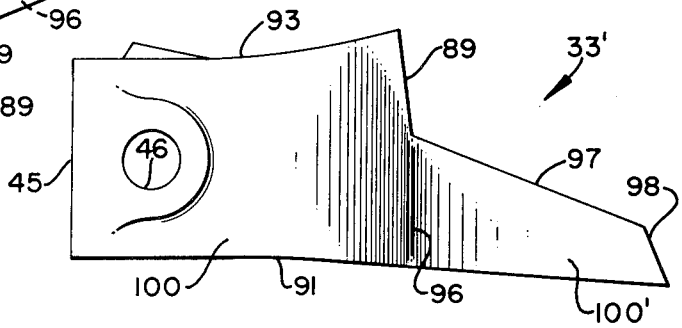
FIG. 14 is a bottom view of the tooth disclosed in FIG. 13.
Figure 15:
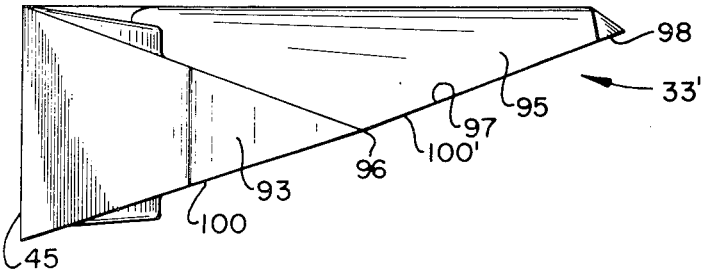
FIG. 15 is a side elevational view of the tooth disclosed in FIGS. 13 and 14.

In the embodiment illustrated in FIGS. 13–15, the digging tooth is provided with a primary penetrating member 98 which extends forwardly of a secondary penetrating member 89. The tooth includes opposed side walls 91 and 93. An elongated upper face 95 of the tool slopes from the upper edge of side wall 91 down to an interface 99 where the two faces are smoothly joined together.

The penetrating end 98 of the tool is ground into the illustrated leading plane which slopes toward face 95 and edge 97. Edge portion 97 is placed at an angle respective to the side walls and joins together the spaced ground engaging members 89 and 98 of the tool.

The penetrating member 98 includes a lower face 100' which joins a lower face 100 at interface 96. Side walls 91 and 93 outwardly diverge in a forward direction respective to one another. Side wall 93 slightly spirals while at the same time curves outwardly from the rear wall toward the cutting edge 89.

Figure 16:
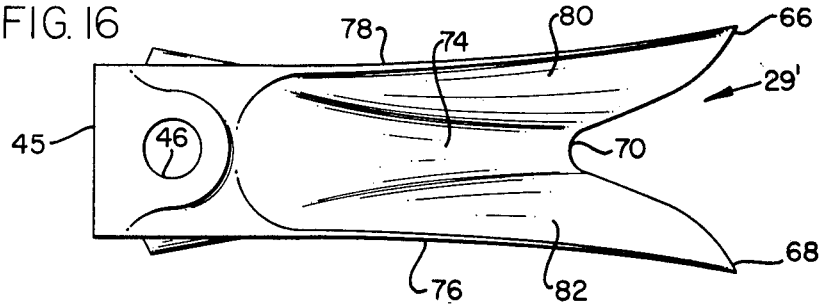
FIG. 16 is a top plan view of still another embodiment of an excavating tooth used in conjunction with the bucket of the present invention.
Figure 17:
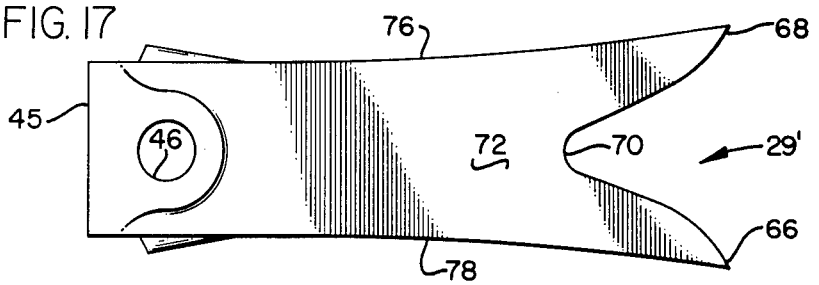
FIG. 17 is a bottom view of the tooth disclosed in FIG. 16.
Figure 18:
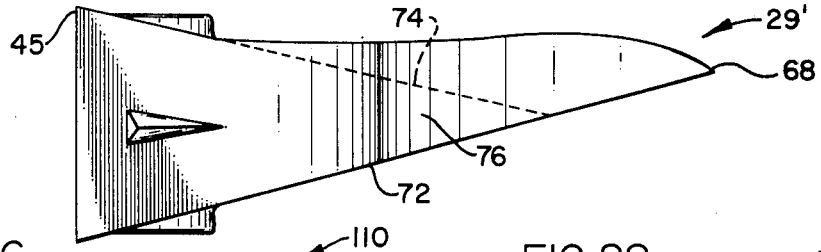
FIG. 18 is a side elevational view of the tooth disclosed in FIGS. 16 and 17.

The embodiment of FIGS. 16–18 discloses a central digging tooth 29' having a bifurcated forward marginal end comprised of spaced similar digging members 66 and 68 which curve rearwardly and downwardly toward a recessed midportion 70. The tooth is symmetrical on either side of a vertical plane passed centrally therethrough and includes a bottom face 72 which is upwardly inclined towards the midportion 70. Centrally located face 74 is equally spaced from opposed side walls 76 and 78 by the inclined faces 80 and 82 of the opposed forwardly directed digging members.

Side walls 76 and 78 slightly spiral away from one another and diverge in a forwardly direction in the illustrated manner of the drawings.

FIGS. 19–25 set forth one embodiment of a set of excavating teeth which may be employed in conjunction with an excavating bucket made in accordance with the present invention.

Figure 19:
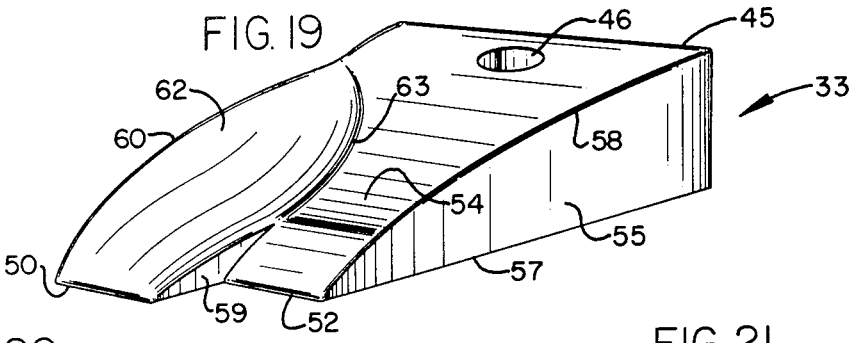
FIG. 19 is a three-quarter front perspective view of still another embodiment of an excavating tooth made in accordance with the present invention.

FIG. 19 specifically discloses an excavating tooth 33. The tooth includes a trailing end 45 which forms the shank thereof. Aperture 46 cooperates with the illustrated apertures formed in the tooth-receiving sockets 32' of FIG. 1. The tooth is hollow at 48 for snugly receiving the forward portion of a tooth receiving socket therewithin, with the apertures of the socket and the shank being indexed with one another to thereby receive a bolt or pin therethrough.

The leading edge 50 of the excavating tooth is in the form of a chisel. The leading edge is forwardly spaced from a second leading edge 52 of a secondary digging member which is also in the form of a chisel. The tooth upwardly slopes at 54 towards the rear 45, thereby leaving a relatively flat bottom edge portion 57 and an upwardly curved edge portion 58.

Figure 20:
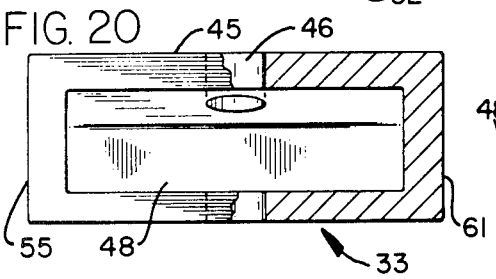
FIG. 20 is an enlarged, part cross-sectional, rear view of the tooth disclosed in FIG. 19.
Figure 21:
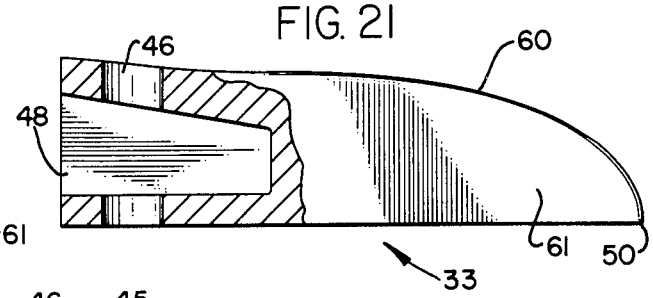
FIG 21 is a part cross-sectional, side elevational view of the tooth disclosed in FIGS. 19 and 20.

Member 50 has a vertical sidewall 59 resulting from removal of material for formation of the secondary chisel-like tooth 52. As seen in FIGS. 20 and 21 the leading member 50 includes a sidewall 61 which is parallel to and opposed to the side wall 55. Member 50 is sloped from edge portion 60 towards the vertical wall 59, thereby presenting an inclined face 62 which downwardly slopes towards face 54, with the faces 54 and 62 jointly forming an interface at 63.

Accordingly, the tooth 33 includes a forwardly directed pilot portion 50 which initially engages and excavates material, thereby enabling member 52 to likewise engage and remove adjacent material rearwardly of member 50.

Material engaged by member 50 is folded by face 62 towards the vertical wall 55 because of the sloped face 62. Material excavated by member 52 is lifted in an upward direction where it encounters the previously removed material which is being moved upwardly and laterally and rearwardly by face 62 so that all of the material excavated by the tooth is moved upwardly, rearwardly, and towards the center of the bucket.

Figure 22:
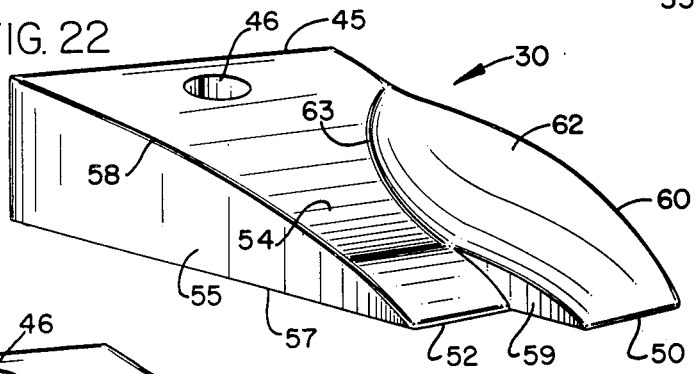
FIG. 22 is a three-quarter front perspective view of still another embodiment of an excavating tooth which can be used in conjunction with the bucket of the present invention.

The digging tooth of FIG. 22 is a mirror image of the tooth illustrated in FIGS. 19–21. In this instance, material engaged by member 50 is lifted upwardly and laterally by the inclined face 62, where the material flows up into the bucket along with the additional material which is simultaneously removed by member 52.

Figure 23:
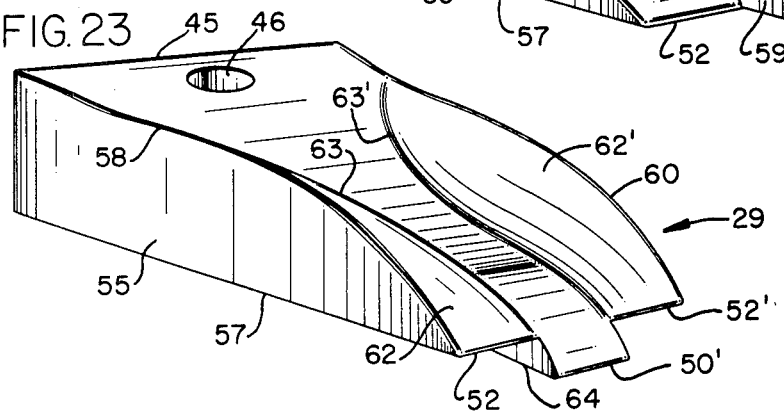
FIG. 23 is a three-quarter front perspective view of still another embodiment of an excavating tooth of the present invention which can be used in conjunction with the bucket of the present invention.
Figure 24:
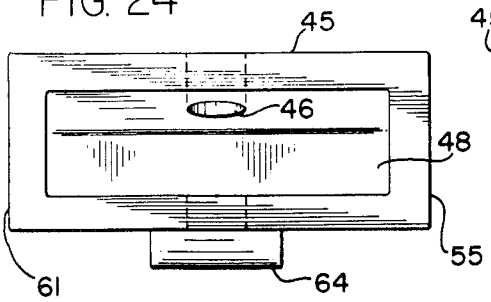
FIG. 24 is a rear view of the tooth disclosed in FIG. 23.
Figure 25:
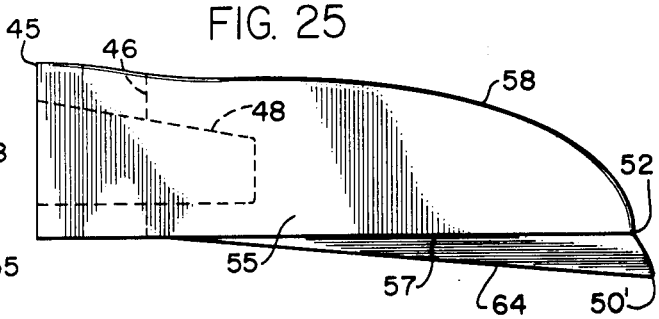
FIG. 25 is a side elevational view of the tooth disclosed in FIGS. 23 and 24.

In the embodiment of FIGS. 23–25, there is disclosed a central excavating tooth 29 which includes a centrally located excavating member 50'; and, opposed, inwardly sloped, excavating members 52 and 52'. Members 52 and 52' have an upper, inwardly sloped surface 62, 62', which meet the central, horizontally disposed surface along the two spaced interfaces indicated by numerals 63 and 63'. The central member 50' underlies and forwardly projects respective to the opposed secondary members 52, 52', thereby leaving spaced vertical, opposed walls 64.

In operation, the central digging tooth illustrated in FIGS. 23–25 provides a centrally located member 50' which engages and lifts excavated material upwardly and rearwardly. Members 52, 52' are mirror images of one another and lie rearwardly and above member 50'. The opposed members 62, 62'therefore turn or fold the excavated material towards the centralmost portion of the bucket.

Figure 4:
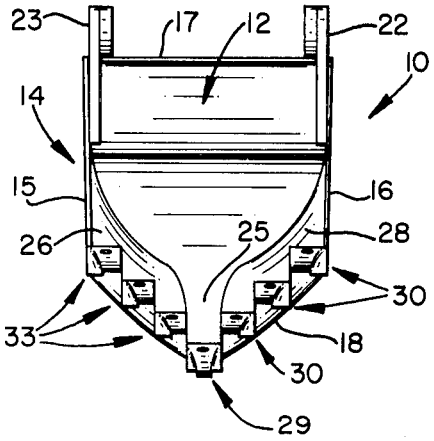
FIG. 4 is a front view of the bucket disclosed in the foregoing figures.
Figure 5:
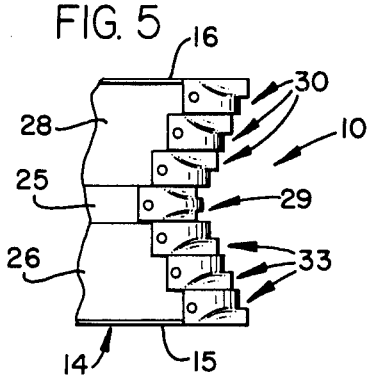
FIG. 5 is a fragmented, top view of the bucket disclosed in the foregoing figures.
Figure 6:
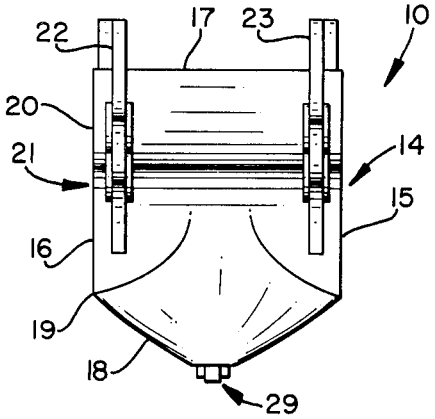
FIG. 6 is a rear view of the bucket disclosed in the foregoing figures.

It should be noted that commencing at the central portion of the central tooth 29 of FIGS. 4 and 23 and progressing outwardly towards either side of the bucket, there will be encountered a series of excavating members which are arranged respective to one another, to the bucket, and to the material being excavated, such that a number of different, unexpected and beneficial results accrue. Commencing with the most central digging member 50' of the central digging tooth 29, for example, it will be noted that excavating members 52 and 52' are located laterally, rearwardly, and above member 50'. At the same time members 52, 52' urge excavated material toward the central portion of the bucket.

As illustrated in FIGS. 1 and 4, and progressing laterally toward the left side of the bucket, for example, tooth 33 is encountered. This particular configuration of the excavating tooth presents a forwardly directed excavating member which precedes a secondary member thereof to pry material loose, thereby leaving a surface which must be encountered and removed by the secondary member; however, the surface to be removed by the secondary member has already had material removed from the two sides thereof, thereby leaving material attached at only two sides thereof which is more readily engaged and removed. This phenomenon is best understood by comparing FIG. 7 with FIGS. 10–25, along with the various figures of the digging bucket.

As one progresses to the next excavating tooth, this same phenomenon will be encountered until the outermost tooth is viewed.

Figure 26:
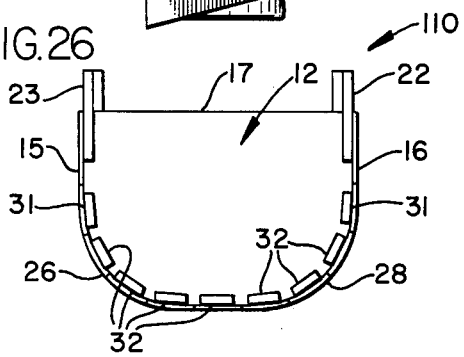
FIG. 26 is a front elevational view of another embodiment of an excavating bucket made in accordance with the present invention.
Figure 27:
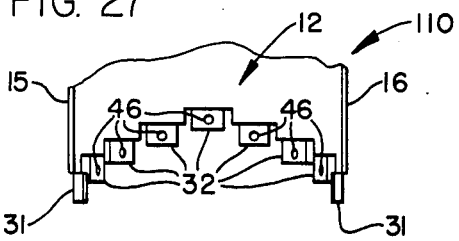
FIG. 27 is a fragmented, top plan view of the bucket disclosed in FIG. 26.

FIGS. 26 and 27 are a representation of another embodiment of the bucket disclosed in the previous figures. The bucket of FIG. 26 has a leading edge which is substantially U-shaped, or a semi-circle, with the individual digging teeth thereof being arranged thereon about the circumference of the bucket whereby the leading edge of each tooth lies at a different angle respective to the horizontal as compared to the corresponding angle of any adjacent tooth. The bucket of FIGS. 26 and 27 is provided with a central tooth receiving socket which lies parallel to the horizontal, intermediate teeth receiving sockets which lie at different angles respective to one another, and the illustrated outermost and uppermost tooth receiving sockets. Where the bucket is exactly a semi-circle, the outermost teeth are arranged to have a cutting edge disposed normally to the cutting edge of the centrally located tooth. Hence, the teeth are each arranged at a different angle respective to one another about the circumferentially disposed bucket lip.

The bucket of FIGS. 26 and 27 is provided with a sloped bottom which diverges in an upward direction into a sloped rear wall in a manner similar to the bucket illustrated in FIGS. 1–9.

Figure 28:
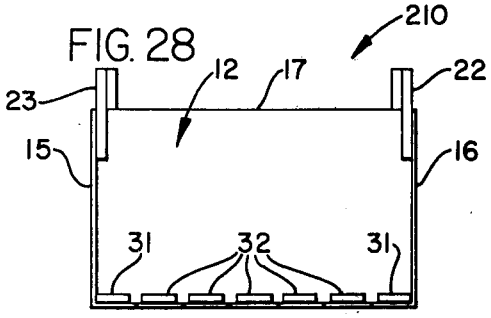
FIG. 28 is a front elevational view of another embodiment of an excavating bucket made in accordance with the present invention.
Figure 29:
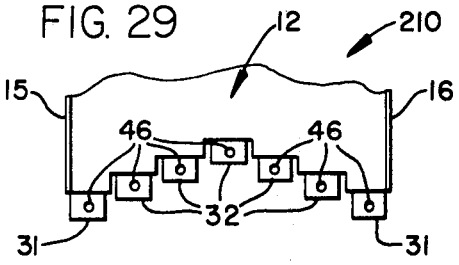
FIG. 29 is a fragmented, top plan view of the bucket disclosed in FIG. 28.

In the embodiment of the invention illustrated in FIGS. 28 and 29, the bucket is of square configuration, and includes a central and rearwardly located excavating tooth, with there being other teeth on each opposed side which extend forwardly of the central tooth. The teeth receiving sockets of FIGS. 28 and 29 lie in the same horizontal plane; and therefore, the bucket presents spaced vertical sidewalls which are devoid of excavating teeth. Accordingly, the power requirements for utilization of the bucket of FIG. 29 as compared to the first embodiment of the invention requires a substantial additional amount of power for operation.

In operation of the first embodiment of the invention, using a bucket constructed substantially as illustrated, the bucket digs into the earth in a conventional manner. The precise angle with which the bottom of the bucket is arranged respective to the bottom of the ditch is determined by the type of material being excavated. For example, when digging into fairly loose soil, it is advantageous to tilt the bucket so that each of the teeth uniformly engage the same depth of soil. The teeth are arranged so that approximately 18 inches of material overlies each of the excavating teeth, for example. At the same time, the operator can slightly adjust the angle of the bucket to improve its efficiency of operation. The operator soon learns to "tune" his ear to the engine noise of the backhoe so that he can ascertain the most optimum angle to be employed to optimize the power consumed by the apparatus.

Upon engaging hard surfaces, such as shale or other rocklike substances, the bucket is tilted towards the uncurled position, thereby causing the centrally located tooth to dig further into the shale, as compared to the outermost teeth.

On the other hand, where it is desired to contour the excavated ditch into a flat bottom, the bucket can be further uncurled so that the aligned ends of the teeth at 34 simultaneously engage the bottom of the ditch. This enables the marginal ends of the teeth to be forced slightly below the surface of the ditch where it can be raked level in this manner.

Figure 7:
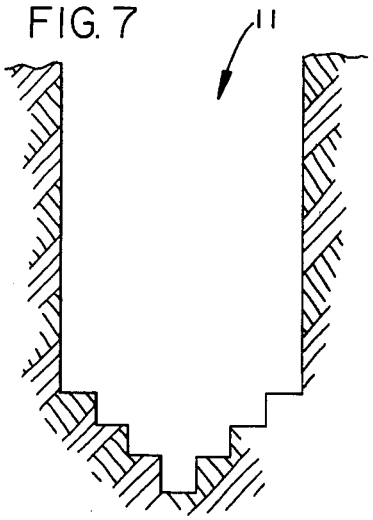
FIG. 7 is a schematical presentation of a cross-section of a strata of the earth from which material has been excavated by employment of the excavating bucket of this invention.

A further advantage gained with the present invention is the savings in padding material which is usually required in laying pipelines. In FIG. 7, for example, the bottom of the ditch is contoured in the illustrated stairstep manner so that the sides of the ditch slope toward the center in a saw-toothed manner. This expedient saves a tremendous amount of padding material, and furthermore centrally positions the pipe laid within the ditch in the most optimum manner.

Sometimes it is expeditious to dig the ditch in accordance with FIG. 7 and thereafter complete the bottom of the ditch by utilizing the embodiment of the invention disclosed in FIGS. 26 and 27.

I claim:

1. The method of excavating earth with a bucket having a curved bottom, curved back and leading edge all of which are substantially V shaped, with a plurality of digging teeth mounted on the leading edge; the tooth at the center of the V leading edge being rearmost and lowermost of all teeth and having a midportion and adjacent sidewise sloping side portions; additional teeth located adjacent each other and on either side of the central tooth, with each additional tooth extending more forwardly and above the adjacent tooth as measured from the central tooth, each of the additional teeth having two integral portions with one integral portion sloping sidewise and extending further forward than the other integral portion, and the one integral portion being further away from the central tooth than the other integral portion, the method steps comprising;

simultaneously engaging the earth will all of the bucket teeth and moving in a forward direction to cut a trench with the central tooth making the deepest groove in the trench and the teeth immediately adjacent the central tooth making a shallower groove, and the teeth furthest from the central tooth making the shallowest groove;

continuously cutting material laterally across the entire trench thereby engaging and removing material in advance of the bucket to prevent the bucket leading edge from engaging and cutting material which forms the trench.

2. The method of claim 1 including the step of the midportion of the central tooth engaging the earth in advance of the side portions of the central tooth, the midportion penetrating and forcing the earth to ride upwardly and rearwardly, and the side portions forcing the earth to ride upwardly, rearwardly and inwardly toward the center of the bucket.

3. The method of claim 2 including the step of having one integral portion of the additional teeth engaging the earth in advance of the other integral portion, with the one integral portion penetrating and forcing the earth upwardly, backwardly and inwardly toward the center of the bucket and the other integral portion forcing the earth mainly upwardly and backwardly.

4. The method of claim 3 including the step of moving the earth into the bucket and contacting the bucket curved bottom and curved back, which are substantially V shaped, thus causing the excavated material to move rearward, upward and toward the center of the bucket in self supporting form of discrete increments of material.

5. The method of claim 4 wherein uncurling of the bucket results in the step of substantial unrolling of the excavated material during unloading to facilitate the dumping operation along with minimizing the sticking of the material to the bucket.

6. The method of claim 3 wherein the one integral portion of the additional teeth includes a diagonal cutting edge which provides the additional step of shearing or cutting the earth at a diagonal to reduce the effort required to load the bucket.

7. The method of claim 1, and further including the step of having two integral portions on all of the teeth to simultaneously engage the earth in advance of the bucket leading edge, thus causing the excavated material to form a trench which has a plurality of opposed ledges descending towards a central ledge with each ledge having only a bottom and only one side wall, save the central ledge.

8. Method of excavating material from the earth comprising the steps of:

mounting a plurality of digging teeth onto a forward edge of an excavating bucket and arranging the teeth into a geometrical pattern such that when the bucket is moved relative to the earth to cause the teeth to penetrate and dig material from the earth, the excavated material leaves an excavation in the form of a trench which has a plurality of opposed ledges descending towards a central ledge with each ledge having only a bottom and only one sidewall, save the central ledge;

forming each digging tooth into two distinct digging members and locating one of said two members in advance of the other;

engaging the sidewall and bottom of a ledge with said one member which is located in advance of the other and thereafter using the other member to complete the ledge;

arranging each tooth in spaced relation respective to one another with the effective cutting edges of the teeth being made of a sufficient width to jointly cut material all the way laterally across the trench from one sidewall to the other sidewall thereof; thereby removing all material in advance of the bucket forward edge.

9. The method of claim 8 and further including the step of arranging a symmetrical tooth centrally of the bucket and arranging asymmetrical teeth on either side of the central tooth, with the asymmetrical teeth located on one side of the bucket being mirror images of the teeth located on the other side of the bucket.

10. The method of claim 8 and further including the step of progressively curving the sidewalls of the bucket in a rearward direction and decreasing the cross-sectional area thereof while at the same time upwardly curving the bottom of the bucket to thereby prevent material from adhering to the interior thereof.

11. The method of claim 8 and further including the step of positioning a single digging tooth centrally and below said plurality of teeth; engaging the ground with the single digging tooth to form a lowermost excavation, with there being adjacent excavations formed by said plurality of teeth.

12. The method of claim 8 and further including the step of forming a third distinct digging member on each digging tooth and locating two of the three digging members into a pair of diverging forwardly extending ground engaging members with one of said three members being located rearwardly of the pair of diverging members.

13. The method of claim 7 and further including the step of arranging symmetrical teeth on said forward edge of the bucket and having two integral portions of the teeth extend in a forward diverging direction so that each forwardly extending integral portion of the teeth engages the earth in advance of the rest of the tooth to thereby engage and remove earth simultaneously from two spaced horizontal areas to thereby form a single ledge which cooperates with other adjacent ledges to form a trench having a V shaped bottom.

14. The method of claim 7 and further including the step of causing the excavated material to move in an upwardly curved direction as it enters the bucket by progressively upwardly curving the V-shaped bottom of the bucket in a rearward direction with the included angle between the V increasing until it smoothly joins the back of the bucket with the angle of the V being about 90° at the bucket lip and increased rearwardly until it reaches substantially 180°.

15. Method of excavating earth, comprising:

forming the ground engaging leading edge of an excavating bucket into a V;

mounting a plurality of digging teeth in spaced relation on said leading edge;

arranging said digging teeth in pairs with each tooth of a pair being affixed in the same relative position to opposed sides of the bucket leading edge;

positioning any outer pair of teeth forwardly and above any inner pair of teeth and arranging the teeth laterally of one another so that the teeth present a continuous cutting edge when the bucket is viewed from above, thereby effecting a continuous cutting action which extends across the entire width of the bucket;

including the step of forming each tooth into two different ground engaging members; extending one ground engaging member in advance of the other ground engaging member, and removing material with said one member in advance of the other member.

16. The method of claim 15 and further including the step of simultaneously engaging the ground with all of the teeth to thereby excavate material to leave a saw-tooth configuration conprised of a plurality of spaced cuts which are limited to a floor and only one side wall, with there being pairs of cuts, with one cut of each pair being formed on opposed sides of the excavation.

17. The method of claim 15 and further including the step of positioning a single digging tooth centrally and below said plurality of teeth; engaging the ground with the single digging tooth to form a lowermost excavation, with there being adjacent excavations formed by said plurality of teeth.

18. The method of claim 15 and further including the step of progressively curving the sides of the bucket in a rearward direction and decreasing the cross-sectional area thereof while at the same time upwardly curving the bottom of the bucket to thereby prevent material from adhering to the interior thereof.

19. The method of claim 15 and further including the step of arranging said V such that the included angle defined by the teeth on the opposed leading edges of the V is substantially 90° when viewed from the leading end of the bucket, thereby excavating a trench which has a V-shaped bottom having sidewalls sloped substantially 45° respective to the horizontal and substantially 90° respective to one another.

20. The method of claim 19 wherein the teeth are arranged along a line which in plan view forms a V having an included angle of substantially 140°.

21. A digging bucket having opposed sides joined to a back wherein the back extends down and turns in a forward direction where it forms a bottom of the bucket and continues forward until it terminates in a tooth receiving V-shaped lip; a plurality of teeth mounted in spaced apart relation on said lip and adapted to engage the earth to remove material and thereby form a trench;

the bottom of the bucket having a forward edge portion which forms said lip and said bottom has opposed edges laterally positioned respective to said lip which is connected to said sides and comprising opposed sloped portions joined together to form a V, the included angle of which progressively increases in a rearwardly direction of 180° as the bottom upwardly slopes into said back; such that said bottom and said back are positioned normal to one another;

the outer peripheral edge of said sides, rear, and lip forms the periphery of the opening into the bucket;

the bucket lip having a plurality of digging teeth thereon arranged such that the cutting edges thereof jointly cooperate to form a ditch having a V-shaped bottom made of spaced ledges which descend downwardly from each sidewall of the ditch so that each of the teeth located to either side of the central tooth digs a ledge having only a bottom and one sidewall.

22. The digging bucket of claim 21 wherein the teeth on said bucket are arranged to present a V-shaped leading edge having an included angle of about 90° therebetween when viewed from the front and having an included angle of more than 90° when viewed from the top of the bucket.

23. The digging bucket of claim 21 wherein each said tooth is arranged in spaced relation both laterally and vertically respective to one another and having a forward ground engaging cutting edge which cooperate together to remove all of the earth in advance of the bucket lip.

24. The digging bucket of claim 23 wherein each said tooth includes a pair of forwardly diverging ground engaging members which preceed the bucket lip and which forms the ledges of the V-shaped trench bottom.

25. A digging bucket which includes opposed sides, a back, a tooth receiving V-shaped lip, said opposed sides being joined to said back, said back extends first in a downward direction and then turns in a forward direction with the forwardly extending part of the back forming a bottom of the bucket; said bottom continues in a forward direction until it terminates in said tooth receiving V-shaped lip; a plurality of teeth mounted in spaced apart relation on said lip and adapted to engage the earth to remove material and thereby form a trench;

said bottom includes opposed edges laterally positioned respective to said lip which are connected to said sides, said bottom comprising opposed sloped portions joined together to form a V, the included angle of which progressively increases in a rearwardly direction to 180° as said bottom upwardly slopes into said back, such that said bottom and said back are positioned normal to one another;

the outer pheripheral edge of said sides, rear, and lip forms the periphery of the opening into said bucket;

said lip having a plurality of digging teeth arranged thereon such that the cutting edges of said teeth jointly cooperate together to form a ditch having a V-shaped bottom made of spaced ledges which descent downwardly from each sidewall of the ditch so that each of the teeth located to either side of a central tooth of said teeth digs a ledge having only a bottom and one sidewall;

each said tooth is arranged in spaced relation both laterally and vertically respective to one another and includes a forward ground engaging cutting edge which cooperate together to remove all of the earth in advance of the bucket lip;

each said tooth includes a pair of forwardly diverging ground engaging members which precede the bucket lip and which forms the recited ledges of the V-shaped trench bottom.

26. An outwardly opening excavating bucket having mount means by which said bucket can be attached to a digging machine, said bucket includes spaced sidewalls, a rear wall, and a bottom wall all joined together to form an enclosure within which excavated material can be received;

said bottom of the bucket having a ground engaging forward edge portion which forms a lip, said bottom has opposed edges laterally positioned respective to said lip which is connected to said sides and comprising opposed sloped portions joined together to form a V, the included angle of which progressively increases in a rearwardly direction as the bottom upwardly slopes into said back; such that said bottom and said back are positioned substantially normal to one another;

the outer peripheral edge of said sides, rear, and lip forms the periphery of the opening into the bucket;

the bucket lip having a plurality of digging teeth mounted thereon and arranged such that the cutting edges thereof jointly cooperate to form a ditch having a V-shaped bottom made of spaced ledges which descend downwardly from each sidewall of the ditch so that each of the teeth located to either side of a central one of the teeth digs a ledge having only a bottom and one sidewall;

any outermost pair of teeth being located forwardly and above any inner pair of teeth, each of said teeth being arranged laterally of one another, said forward ground engaging end of said teeth are of a size and configuration and are arranged respective to one another such that the teeth jointly cooperate to present a continuous cutting edge across the entire width of the bucket, thereby removing material in advance of said lip.

* * * * *

UNITED STATES PATENT OFFICE

CERTIFICATE OF CORRECTION

Patent No. 4,123,861 Dated NOVEMBER 7, 1978

Inventor(s) CHARLES WAYNE HEMPHILL

It is certified that error appears in the above-identified patent and that said Letters Patent are hereby corrected as shown below:

Column 2, line 55, substitute --downward-- for "downwardly";
Line 66, substitute --preceding-- for "proceeding".

Column 5, line 51, insert --in--before "conjunction";
Line 54, correct the spelling of "complementary";
Line 67, substitute --relationship-- for "relation".

Column 6, line 40, correct the spelling of "saw-tooth".

Column 10, line 40, substitute --with substantially-- for "will".

Column 11, line 35, insert --, save a central tooth, -- before "into".

Column 12, line 1, insert --, save a central tooth,-- before "and";
Line 6, substitute --Claim 8-- for "Claim 7";
Line 13, delete "thereby";
Line 16, substitute --Claim 8-- for "Claim 7";
Line 36, insert --substantially-- before "continuous";
Line 37, insert --substantially-- before "continuous";
Line 49, correct the spelling of "comprised".

Column 13, line 21, substitute --to substantially-- for "of";
Line 23, insert --substantially-- before "normal".

UNITED STATES PATENT OFFICE

CERTIFICATE OF CORRECTION

Patent No. 4,123,861 Dated NOVEMBER 7, 1978

Inventor(s) CHARLES WAYNE HEMPHILL

It is certified that error appears in the above-identified patent and that said Letters Patent are hereby corrected as shown below:

Column 14, line 4, insert --substantially-- before "180°";
Line 6, insert --substantially-- before "normal";
Line 14, correct spelling of "descend";
Line 33, insert --wall-- after "bottom";
Line 35, insert --wall-- after "tom";
Line 40, insert --wall-- after "bottom"; and substitute --rear wall-- for "back";
Line 41, insert --wall-- after "bottom"; and substitute --rear wall-- for "back".

Signed and Sealed this

First Day of May 1979

[SEAL]

Attest:

RUTH C. MASON
Attesting Officer

DONALD W. BANNER
Commissioner of Patents and Trademarks